US011210991B2

(12) United States Patent
Chung et al.

(10) Patent No.: US 11,210,991 B2
(45) Date of Patent: Dec. 28, 2021

(54) METHOD OF GENERATING CORRECTION DATA FOR DISPLAY DEVICE, TEST DEVICE, AND DISPLAY DEVICE

(71) Applicant: Samsung Display Co., Ltd., Yongin-si (KR)

(72) Inventors: Jae-Seob Chung, Asan-si (KR); Hoi Sik Moon, Hwaseong-si (KR); Hyung Woo Yim, Hwaseong-si (KR); Kang Hyun Kim, Seoul (KR); Hak Mo Choi, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/107,723

(22) Filed: Nov. 30, 2020

(65) Prior Publication Data

US 2021/0280111 A1 Sep. 9, 2021

(30) Foreign Application Priority Data

Mar. 6, 2020 (KR) ..... 10-2020-0028637

(51) Int. Cl.
*G09G 3/00* (2006.01)
*G09G 3/20* (2006.01)

(52) U.S. Cl.
CPC ..... *G09G 3/2092* (2013.01); *G09G 3/006* (2013.01); *G09G 2320/0233* (2013.01); *G09G 2320/0276* (2013.01); *G09G 2320/0673* (2013.01)

(58) Field of Classification Search
CPC combination set(s) only.
See application file for complete search history.

(56) References Cited

U.S. PATENT DOCUMENTS 8,610,781 B2 * 12/2013 Wei ..... G09G 3/36 348/191
10,803,782 B2 * 10/2020 Murase ..... G09G 3/20
11,011,086 B2 * 5/2021 Park ..... G09G 3/3688
(Continued)

FOREIGN PATENT DOCUMENTS

KR 10-2013-0061419 A 6/2013
KR 10-2015-0030013 A 3/2015
(Continued)

*Primary Examiner* — Gene W Lee
(74) *Attorney, Agent, or Firm* — Lewis Roca Rothgerber Christie LLP

(57) ABSTRACT

In a method of generating correction data for each of a plurality of display devices, a characteristic distribution for initial display devices among the plurality of display devices may be obtained, center characteristic compensation data may be generated based on the characteristic distribution for the initial display devices, the center characteristic compensation data may be applied to subsequent display devices that are subsequent to the initial display devices among the plurality of display devices, mura correction data and image quality correction data may be generated by performing mura correction and image quality correction on each of the subsequent display devices to which the center characteristic compensation data are applied, and the center characteristic compensation data, the mura correction data and the image quality correction data may be written into each of the subsequent display devices.

17 Claims, 11 Drawing Sheets

(56) References Cited

U.S. PATENT DOCUMENTS

| | | | | |
|---|---|---|---|---|
| 2010/0309219 | A1* | 12/2010 | Lee | H04N 1/6052 345/590 |
| 2019/0268590 | A1* | 8/2019 | Kato | H04N 17/00 |
| 2020/0051474 | A1* | 2/2020 | Park | G09G 3/006 |

FOREIGN PATENT DOCUMENTS

| | | | |
|---|---|---|---|
| KR | 10-2015-0081085 | A | 7/2015 |
| KR | 10-2016-0006852 | A | 1/2016 |
| KR | 10-1784216 | B1 | 10/2017 |
| KR | 10-1929001 | B1 | 12/2018 |
| KR | 10-2076042 | B1 | 2/2020 |

* cited by examiner

METHOD OF GENERATING CORRECTION DATA FOR DISPLAY DEVICE, TEST DEVICE, AND DISPLAY DEVICE

CROSS-REFERENCE TO RELATED APPLICATION

This application claims priority to and the benefit of Korean Patent Application No. 10-2020-0028637, filed on Mar. 6, 2020 in the Korean Intellectual Property Office (KIPO), the content of which is incorporated herein in its entirety by reference.

BACKGROUND

1. Field

Aspects of some example embodiments of the present inventive concept relate to display devices, and for example, to methods of generating correction data for display devices, test devices, and display devices storing the correction data.

2. Description of the Related Art

Even though a plurality of pixels included in a display device may be manufactured as part of the same manufacturing process, the plurality of pixels may have different luminances or a mura defects due to process variations, or the like. Similarly, even though a plurality of display devices may be manufactured as part of the same manufacturing process, the plurality of display devices may have different gamma characteristics and/or different color coordinate characteristics.

To reduce mura defects in each display device, and to improve luminance uniformity of display devices, an image displayed by the display device may be captured, correction data may be generated based on the captured image, and the correction data may be stored in the display device. This operation may be referred to as mura correction or a mura correction operation. Further, to improve the characteristic distribution of the plurality of display devices, image quality correction may be further performed to correct gamma and/or color coordinate characteristics of respective display devices to a target gamma and/or color coordinate characteristic.

However, in a situation in which the mura correction and the image quality correction are simultaneously (or concurrently) performed, performance of the mura correction and/or the image quality correction may be deteriorated. Further, in a case where the mura correction and the image quality correction are sequentially performed, the test process time for each display device may increase.

The above information disclosed in this Background section is only for enhancement of understanding of the background and therefore the information discussed in this Background section does not necessarily constitute prior art.

SUMMARY

Aspects of some example embodiments include a method of generating correction data for a display device capable of rapidly and accurately generating the correction data for each display device.

Aspects of some example embodiments include a test device capable of rapidly and accurately generating correction data for each display device.

Aspects of some example embodiments include a display device storing center characteristic compensation data, mura correction data and image quality correction data.

Aspects of some example embodiments include a method of generating correction data for each of a plurality of display devices. In the method, a characteristic distribution for initial display devices among the plurality of display devices is obtained, center characteristic compensation data are generated based on the characteristic distribution for the initial display devices, the center characteristic compensation data are applied to subsequent display devices that are subsequent to the initial display devices among the plurality of display devices, mura correction data and image quality correction data are generated by performing mura correction and image quality correction on each of the subsequent display devices to which the center characteristic compensation data are applied, and the center characteristic compensation data, the mura correction data and the image quality correction data are written into each of the subsequent display devices.

According to some example embodiments, to obtain the characteristic distribution for the initial display devices, test data may be provided to each of the initial display devices, measured data may be obtained by capturing an image displayed based on the test data at each of the initial display devices, and gamma characteristic curves of the initial display devices may be obtained based on the measured data.

According to some example embodiments, to generate the center characteristic compensation data based on the characteristic distribution for the initial display devices, an average gamma characteristic curve of the gamma characteristic curves of the initial display devices may be calculated, and the center characteristic compensation data may be generated based on the average gamma characteristic curve and a target gamma characteristic curve.

According to some example embodiments, mura correction data for each of the initial display devices may be generated by performing mura correction based on the measured data for each of the initial display devices, image quality correction data for each of the initial display devices may be generated by performing image quality correction based on the measured data for each of the initial display devices, and default center characteristic compensation data, the mura correction data for each of the initial display devices and the image quality correction data for each of the initial display devices may be written into each of the initial display devices.

According to some example embodiments, to apply the center characteristic compensation data to the subsequent display devices, the center characteristic compensation data may be written into each of the subsequent display devices, test data may be provided to each of the subsequent display devices, the center characteristic compensation data may be added to the test data at each of the subsequent display devices, and an image may be displayed based on the test data to which the center characteristic compensation data are added at each of the subsequent display devices.

According to some example embodiments, to apply the center characteristic compensation data to the subsequent display devices, test data to which the center characteristic compensation data are added may be provided to each of the subsequent display devices, and an image may be displayed based on the test data to which the center characteristic compensation data are added at each of the subsequent display devices.

According to some example embodiments, to generate the mura correction data and the image quality correction data by performing the mura correction and the image quality correction on each of the subsequent display devices to which the center characteristic compensation data are applied, measured data on which the center characteristic compensation data are reflected may be obtained by capturing an image displayed based on test data to which the center characteristic compensation data are added at each of the subsequent display devices, the mura correction data may be generated by performing the mura correction based on the measured data on which the center characteristic compensation data are reflected, the measured data on which the center characteristic compensation data and the mura correction data are reflected may be generated by adding the mura correction data to the measured data on which the center characteristic compensation data are reflected, and the image quality correction data may be generated by performing the image quality correction based on the measured data on which the center characteristic compensation data and the mura correction data are reflected.

According to some example embodiments, to generate the mura correction data and the image quality correction data by performing the mura correction and the image quality correction on each of the subsequent display devices to which the center characteristic compensation data are applied, first measured data on which the center characteristic compensation data are reflected may be obtained by capturing an image displayed based on test data to which the center characteristic compensation data are added at each of the subsequent display devices, the mura correction data may be generated by performing the mura correction based on the first measured data on which the center characteristic compensation data are reflected, second measured data on which the center characteristic compensation data and the mura correction data are reflected may be obtained by capturing an image displayed based on the test data to which the center characteristic compensation data and the mura correction data are added at each of the subsequent display devices, and the image quality correction data may be generated by performing the image quality correction based on the second measured data on which the center characteristic compensation data and the mura correction data are reflected.

According to some example embodiments, to generate the mura correction data and the image quality correction data by performing the mura correction and the image quality correction on each of the subsequent display devices to which the center characteristic compensation data are applied, first measured data on which the center characteristic compensation data are reflected may be obtained by capturing an image displayed based on test data to which the center characteristic compensation data are added at each of the subsequent display devices, the image quality correction data may be generated by performing the image quality correction based on the first measured data on which the center characteristic compensation data are reflected, second measured data on which the center characteristic compensation data and the image quality correction data are reflected may be obtained by capturing an image displayed based on the test data to which the center characteristic compensation data and the image quality correction data are added at each of the subsequent display devices, and the mura correction data may be generated by performing the mura correction based on the second measured data on which the center characteristic compensation data and the image quality correction data are reflected.

Aspects of some example embodiments include a test device that generates correction data for each of a plurality of display devices. The test device includes a center characteristic corrector configured to obtain a characteristic distribution for initial display devices among the plurality of display devices, to generate center characteristic compensation data based on the characteristic distribution for the initial display devices, and to apply the center characteristic compensation data to subsequent display devices that are subsequent to the initial display devices among the plurality of display devices, a mura corrector configured to generate mura correction data by performing mura correction on each of the subsequent display devices to which the center characteristic compensation data are applied, and an image quality corrector configured to generate image quality correction data by performing image quality correction on each of the subsequent display devices to which the center characteristic compensation data are applied.

According to some example embodiments, the test device may provide test data to each of the initial display devices. The test device may further include a capturing device configured to obtain measured data by capturing an image displayed based on the test data at each of the initial display devices. The center characteristic corrector may obtain gamma characteristic curves of the initial display devices based on the measured data, may calculate an average gamma characteristic curve of the gamma characteristic curves of the initial display devices, and may generate the center characteristic compensation data based on the average gamma characteristic curve and a target gamma characteristic curve.

According to some example embodiments, the mura corrector may generate mura correction data for each of the initial display devices by performing mura correction based on the measured data for each of the initial display devices, the image quality corrector may generate image quality correction data for each of the initial display devices by performing image quality correction based on the measured data for each of the initial display devices, and the test device may write default center characteristic compensation data, the mura correction data for each of the initial display devices and the image quality correction data for each of the initial display devices into each of the initial display devices.

According to some example embodiments, the center characteristic compensation data may be applied to the subsequent display devices by writing the center characteristic compensation data into each of the subsequent display devices.

According to some example embodiments, the center characteristic compensation data may be applied to the subsequent display devices by providing test data to which the center characteristic compensation data are added to each of the subsequent display devices.

According to some example embodiments, the test device may further include a capturing device configured to obtain measured data on which the center characteristic compensation data are reflected by capturing an image displayed based on test data to which the center characteristic compensation data are added at each of the subsequent display devices. The mura corrector may generate the mura correction data by performing the mura correction based on the measured data on which the center characteristic compensation data are reflected, the measured data on which the center characteristic compensation data and the mura correction data are reflected may be generated by adding the mura correction data to the measured data on which the center characteristic compensation data are reflected, and the image quality corrector may generate the image quality correction data by performing the image quality correction based on the measured data on which the center characteristic compensation data and the mura correction data are reflected.

According to some example embodiments, the test device may further include a capturing device configured to obtain first measured data on which the center characteristic compensation data are reflected by capturing an image displayed based on test data to which the center characteristic compensation data are added at each of the subsequent display devices, and to obtain second measured data on which the center characteristic compensation data and the mura correction data are reflected by capturing an image displayed based on the test data to which the center characteristic compensation data and the mura correction data are added at each of the subsequent display devices. The mura corrector may generate the mura correction data by performing the mura correction based on the first measured data on which the center characteristic compensation data are reflected, and the image quality corrector may generate the image quality correction data by performing the image quality correction based on the second measured data on which the center characteristic compensation data and the mura correction data are reflected.

According to some example embodiments, the test device may further include a capturing device configured to obtain first measured data on which the center characteristic compensation data are reflected by capturing an image displayed based on test data to which the center characteristic compensation data are added at each of the subsequent display devices, and to obtain second measured data on which the center characteristic compensation data and the image quality correction data are reflected by capturing an image displayed based on the test data to which the center characteristic compensation data and the image quality correction data are added at each of the subsequent display devices. The image quality corrector may generate the image quality correction data by performing the image quality correction based on the first measured data on which the center characteristic compensation data are reflected, and the mura corrector may generate the mura correction data by performing the mura correction based on the second measured data on which the center characteristic compensation data and the image quality correction data are reflected.

Aspects of some exemplary embodiments include a display device including a display panel including pixels, a data driver configured to provide data signals to the pixels, a gate driver configured to provide gate signals to the pixels, a controller configured to control the data driver and the gate driver, and a correction data memory configured to store center characteristic compensation data, mura correction data and image quality correction data. The controller includes a data corrector configured to generate output image data by correcting input image data based on the center characteristic compensation data, the mura correction data and the image quality correction data.

According to some example embodiments, the data corrector may include a first data correcting block configured to receive the center characteristic compensation data from the correction data memory, and to generate first corrected image data by adding the center characteristic compensation data to the input image data, a second data correcting block configured to receive the mura correction data from the correction data memory, and to generate second corrected image data by adding the mura correction data to the first corrected image data, and a third data correcting block configured to receive the image quality correction data from the correction data memory, and to generate the output image data by adding the image quality correction data to the second corrected image data.

According to some example embodiments, the center characteristic compensation data stored in the correction data memory may be constant with respect to different display devices.

As described above, in a method of generating correction data and a test device according to some example embodiments, center characteristic compensation data may be generated by obtaining a characteristic distribution for initial display devices, the center characteristic compensation data may be applied to subsequent display devices, and mura correction and image quality correction may be performed on each subsequent display device to which the center characteristic compensation data are applied. Accordingly, the mura correction and the image quality correction for each display device may be rapidly and accurately performed.

Further, a display device according to some example embodiments may store center characteristic compensation data, mura correction data and image quality correction data, and may correct image data based on the center characteristic compensation data, the mura correction data and the image quality correction data. Accordingly, a mura defect of the display device may be reduced or removed, and an image quality of the display device may be improved.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, aspects of some example embodiments of the present inventive concept will be explained in more detail with reference to the accompanying drawings.

Figure 1:
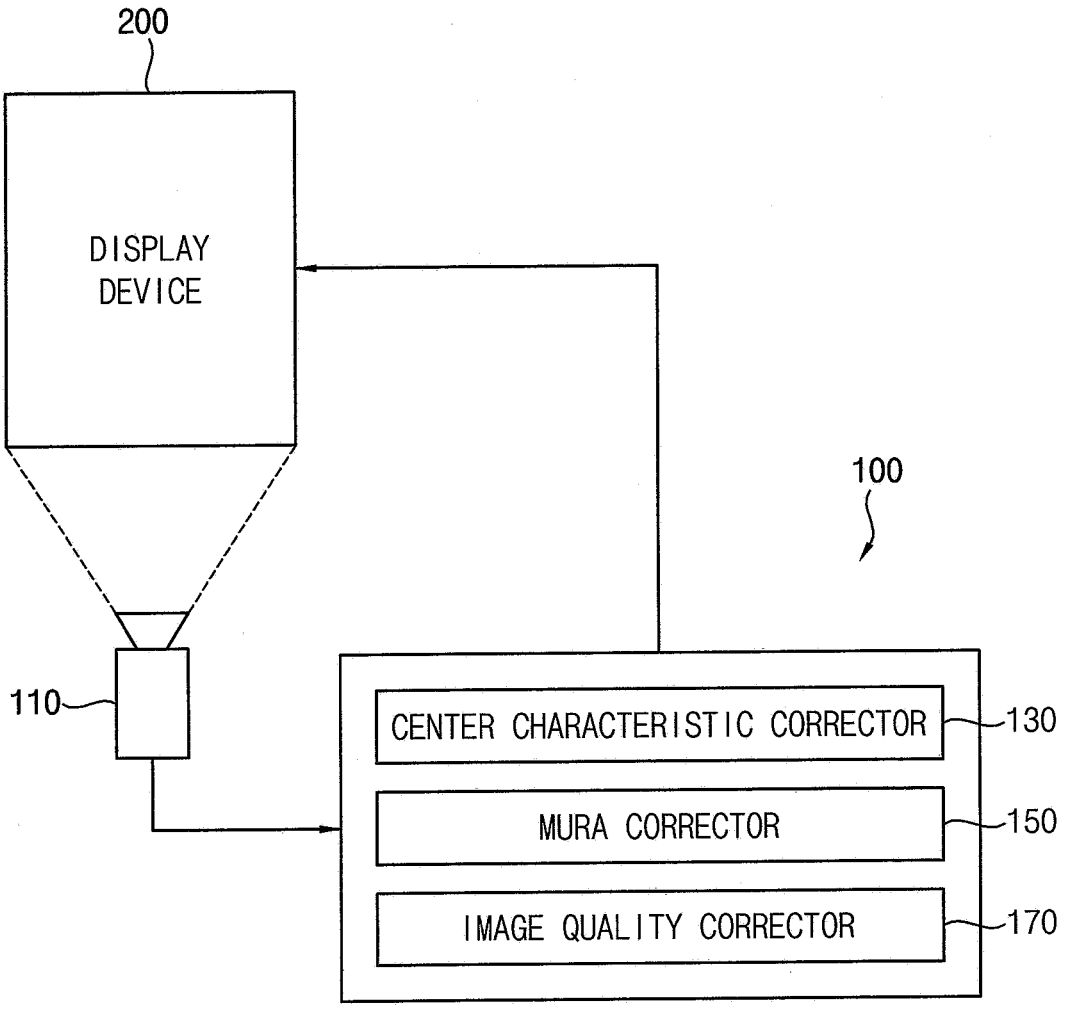
FIG. 1 is a block diagram illustrating a test device that generates correction data for each display device according to some example embodiments.

FIG. 1 is a block diagram illustrating a test device that generates correction data for each display device according to some example embodiments.

Referring to FIG. 1, a test device 100 (or test equipment) according to some example embodiments may generate correction data for each display device 200 of a plurality of display devices. According to some example embodiments, the test device 100 may perform an automatic test process (e.g., an automatic manual test (AMT) process) including mura correction and image quality correction for each display device 200. The test device 100 may include a capturing device 110, a center characteristic corrector 130, a mura corrector 150 and an image quality corrector 170.

The capturing device 110 may obtain measured data by capturing an image displayed at each display device 200. For example, the test device 100 may provide test data to each display device 200, and may obtain the measured data by capturing an image displayed based on the test data at each display device 200. According to some example embodiments, the capturing device 110 may be a camera (e.g., a predetermined camera) such as, but not limited to, a charge coupled device (CCD) camera. Further, according to some example embodiments, the measured data may include, but not be limited to, at least one of red, green or blue luminance data, tristimulus data (e.g., XYZ data), luminance and color coordinate data (e.g., Lxy data) and gamma value data. According to some example embodiments, the test device 100 may respectively provide a plurality of test data representing the entire gray levels (e.g., from a 0-gray level to a 255-gray level) to each display device 200, and the capturing device 110 may obtain a plurality of measured data for the entire gray levels by respectively capturing images at the entire gray levels. According to some example embodiments, the test device 100 may respectively provide one or more test data representing one or more reference gray levels (e.g., a 0-gray level, a 16-gray level, a 24-gray level, a 32-gray level, a 64-gray level, a 128-gray level, a 160-gray level, a 192-gray level, a 224-gray level and a 255-gray level) that are a portion of the entire gray levels to each display device 200, and the capturing device 110 may obtain one or more measured data for the one or more reference gray levels by respectively capturing one or more images at the one or more reference gray levels.

The test device 100 may sequentially perform the automatic test processes (including the mura correction and the image quality correction) for the plurality of display devices.

With respect to a reference number of initial display devices among the plurality of display devices (e.g., ten initial display devices among entire one hundred display devices), the test device 100 may provide test data to each initial display device 200, and may obtain measured data by capturing an image displayed based on the test data at each initial display device 200. The center characteristic corrector 130 may obtain a characteristic distribution for the initial display devices based on the measured data for the initial display devices, and may generate center characteristic compensation data based on the characteristic distribution for the initial display devices.

According to some example embodiments, the characteristic distribution may be a gamma characteristic distribution including gamma characteristic curves at center points of the initial display devices, and the center characteristic corrector 130 may generate the center characteristic compensation data for correcting an average gamma characteristic curve of the gamma characteristic curves to a target gamma characteristic curve based on the average gamma characteristic curve and the target gamma characteristic curve. According to some example embodiments, the characteristic distribution may include the gamma characteristic distribution of the initial display devices and a color coordinate characteristic distribution representing color coordinates at the center points of the initial display devices, and the center characteristic corrector 130 may generate the center characteristic compensation data for correcting the average gamma characteristic curve to the target gamma characteristic curve and correcting an average color coordinate of the color coordinates to a target color coordinate.

The mura corrector 150 may generate mura correction data for each initial display device 200 by performing mura correction based on mura correction based on the measured data for each initial display device 200. For example, the mura correction data may represent compensation gray values at a plurality of sampling positions for reducing or removing a mura defect at each display device 200 and for improving luminance uniformity of each display device 200. The image quality corrector 170 may generate image quality correction data for each initial display device 200 by performing image quality correction based on the measured data for each initial display device 200.

For example, the image quality correction data may represent compensation gray values at respective entire gray levels or respective reference gray levels for allowing the plurality of display devices to have substantially the same gamma characteristic and/or color coordinate characteristic. Further, the test device 100 may write default center characteristic compensation data (e.g., representing compensation gray values of 0), the mura correction data for each initial display device 200 and the image quality correction data for each initial display device 200 into each initial display device 200.

With respect to subsequent display devices that are subsequent to the initial display devices among the plurality of display devices (e.g., ninety subsequent display devices among an entire group of one hundred display devices), the test device 100 may provide test data to each initial display device 200, the center characteristic corrector 130 may apply the center characteristic compensation data to the subsequent display devices. According to some example embodiments, the center characteristic compensation data may be applied to the subsequent display devices by writing the center characteristic compensation data into each subsequent display device 200.

According to some example embodiments, the center characteristic compensation data may be applied to the subsequent display devices by providing test data to which the center characteristic compensation data are added to each subsequent display device 200. The mura corrector 150 may generate mura correction data for each subsequent display device 200 by performing mura correction on each subsequent display device 200 to which the center characteristic compensation data are applied, and the image quality corrector 170 may generate image quality correction data for each subsequent display device 200 by performing image quality correction on each subsequent display device 200 to which the center characteristic compensation data are applied. Further, the test device 100 may write the center characteristic compensation data, the mura correction data and the image quality correction data into each subsequent display device 200.

According to some example embodiments, the capturing device 110 may obtain measured data on which the center characteristic compensation data are reflected by capturing an image displayed based on test data to which the center characteristic compensation data are added at each subsequent display device 200. The mura corrector 150 may generate the mura correction data for each subsequent display device 200 by performing the mura correction based on the measured data on which the center characteristic compensation data are reflected.

The test device 100 may generate the measured data on which the center characteristic compensation data and the mura correction data are reflected by adding the mura correction data to the measured data on which the center characteristic compensation data are reflected. The image quality corrector 170 may generate the image quality correction data for each subsequent display device 200 by performing the image quality correction based on the measured data on which the center characteristic compensation data and the mura correction data are reflected. Thus, in this case, the test device 100 may perform the mura correction and the image quality correction by capturing a single image at each gray level.

According to some example embodiments, the capturing device 110 may obtain first measured data on which the center characteristic compensation data are reflected by capturing an image displayed based on test data to which the center characteristic compensation data are added at each subsequent display device 200. The mura corrector may generate the mura correction data for each subsequent display device 200 by performing the mura correction based on the first measured data on which the center characteristic compensation data are reflected.

Further, according to some example embodiments, the capturing device 110 may obtain second measured data on which the center characteristic compensation data and the mura correction data are reflected by capturing an image displayed based on the test data to which the center characteristic compensation data and the mura correction data are added at each subsequent display device 200. The image quality corrector 170 may generate the image quality correction data for each subsequent display device 200 by performing the image quality correction based on the second measured data on which the center characteristic compensation data and the mura correction data are reflected. Thus, in this case, the test device 100 may perform the mura correction by capturing a first image at each gray level, and then may perform the image quality correction by capturing a second image at each gray level.

According to some example embodiments, the capturing device 110 may obtain first measured data on which the center characteristic compensation data are reflected by capturing an image displayed based on test data to which the center characteristic compensation data are added at each subsequent display device 200. The image quality corrector 170 may generate the image quality correction data for each subsequent display device 200 by performing the image quality correction based on the first measured data on which the center characteristic compensation data are reflected.

Further, the capturing device 110 may obtain second measured data on which the center characteristic compensation data and the image quality correction data are reflected by capturing an image displayed based on the test data to which the center characteristic compensation data and the image quality correction data are added at each subsequent display device 200. The mura corrector 150 may generate the mura correction data for each subsequent display device 200 by performing the mura correction based on the second measured data on which the center characteristic compensation data and the image quality correction data are reflected. Thus, in this case, the test device 100 may perform the image quality correction by capturing a first image at each gray level, and then may perform the mura correction by capturing a second image at each gray level.

In a case where the mura correction and the image quality correction are performed without using the center characteristic compensation data, the mura correction data and the image quality correction data may be affected by each other, and thus performances of the mura correction and the image quality correction may be deteriorated. However, in the test device 100 according to some example embodiments, the center characteristic compensation data may be generated by obtaining the characteristic distribution for the initial display devices, the center characteristic compensation data may be applied to the subsequent display devices, and the mura correction and the image quality correction may be performed on each subsequent display device 200 to which the center characteristic compensation data are applied. Accordingly, the mura correction and the image quality correction for each (subsequent) display device 200 may be rapidly and accurately performed.

Figure 2:
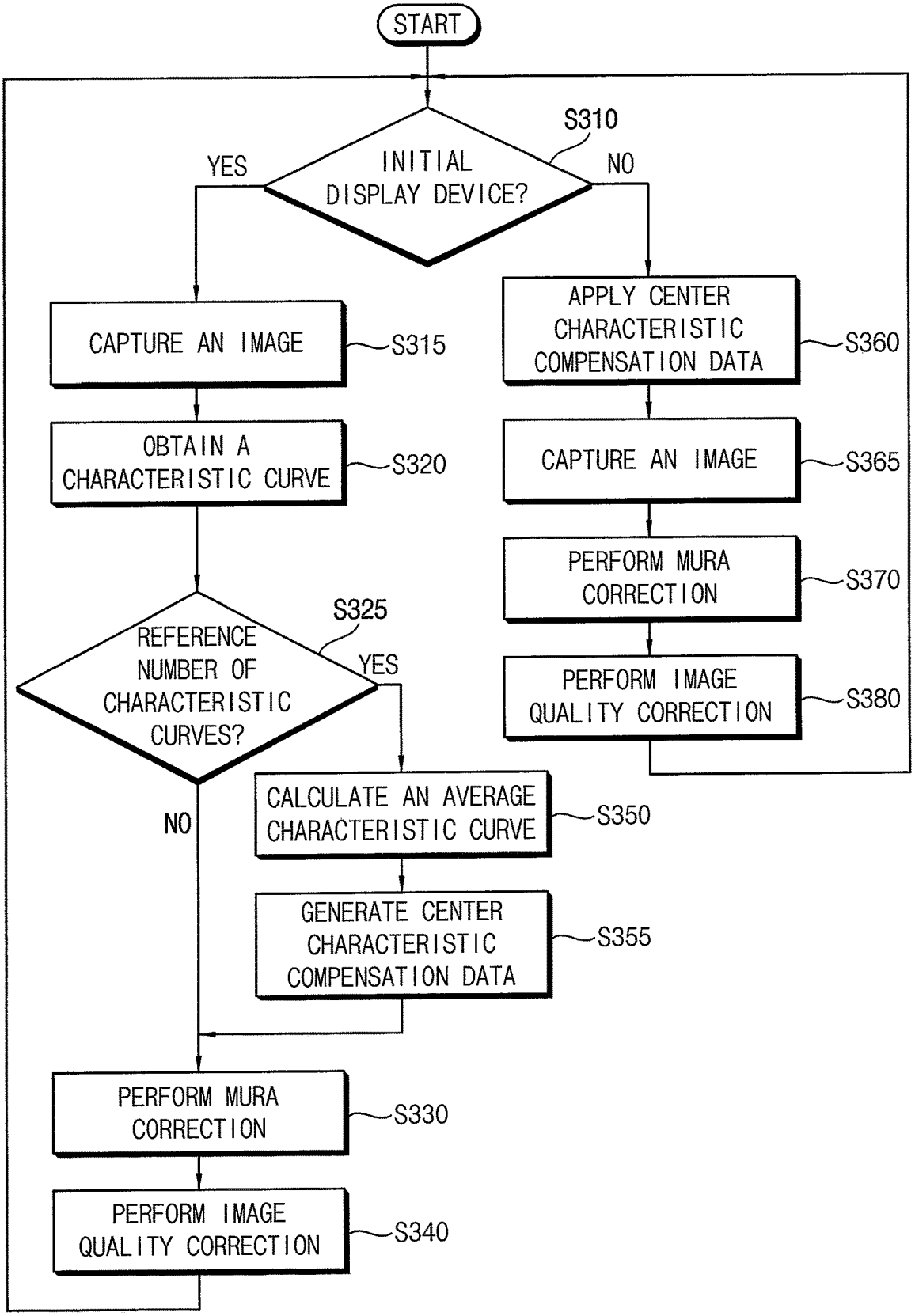
FIG. 2 is a flowchart illustrating a method of generating correction data for each display device according to some example embodiments.
Figure 3:
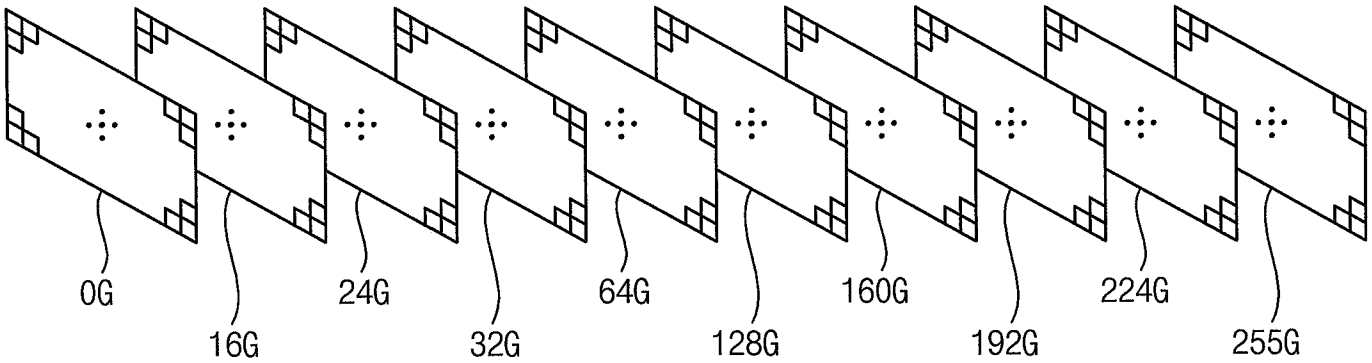
FIG. 3 is a diagram for describing an example of a plurality of reference gray levels at which an image is captured.
Figure 4:
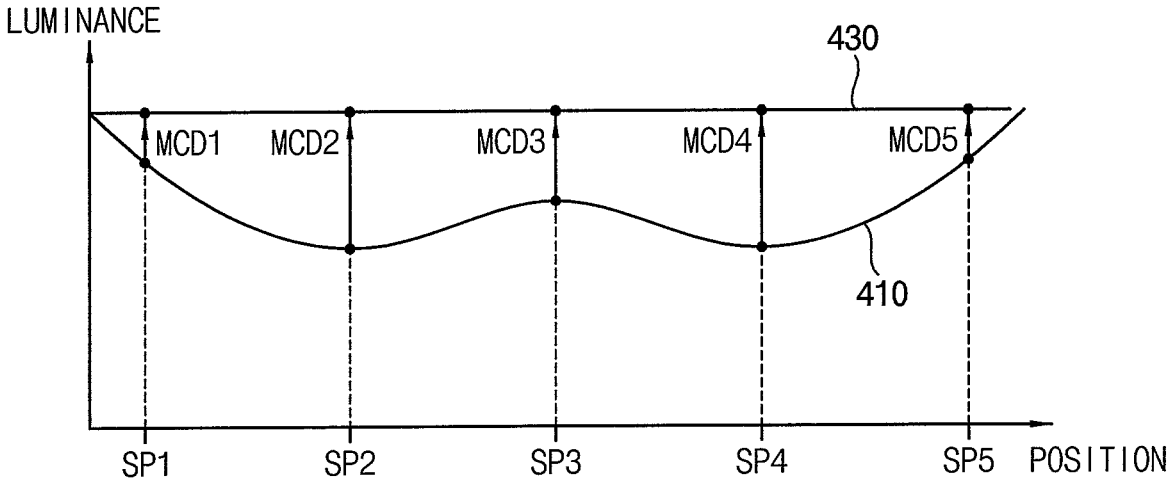
FIG. 4 is a diagram for describing an example of mura correction.
Figure 5:
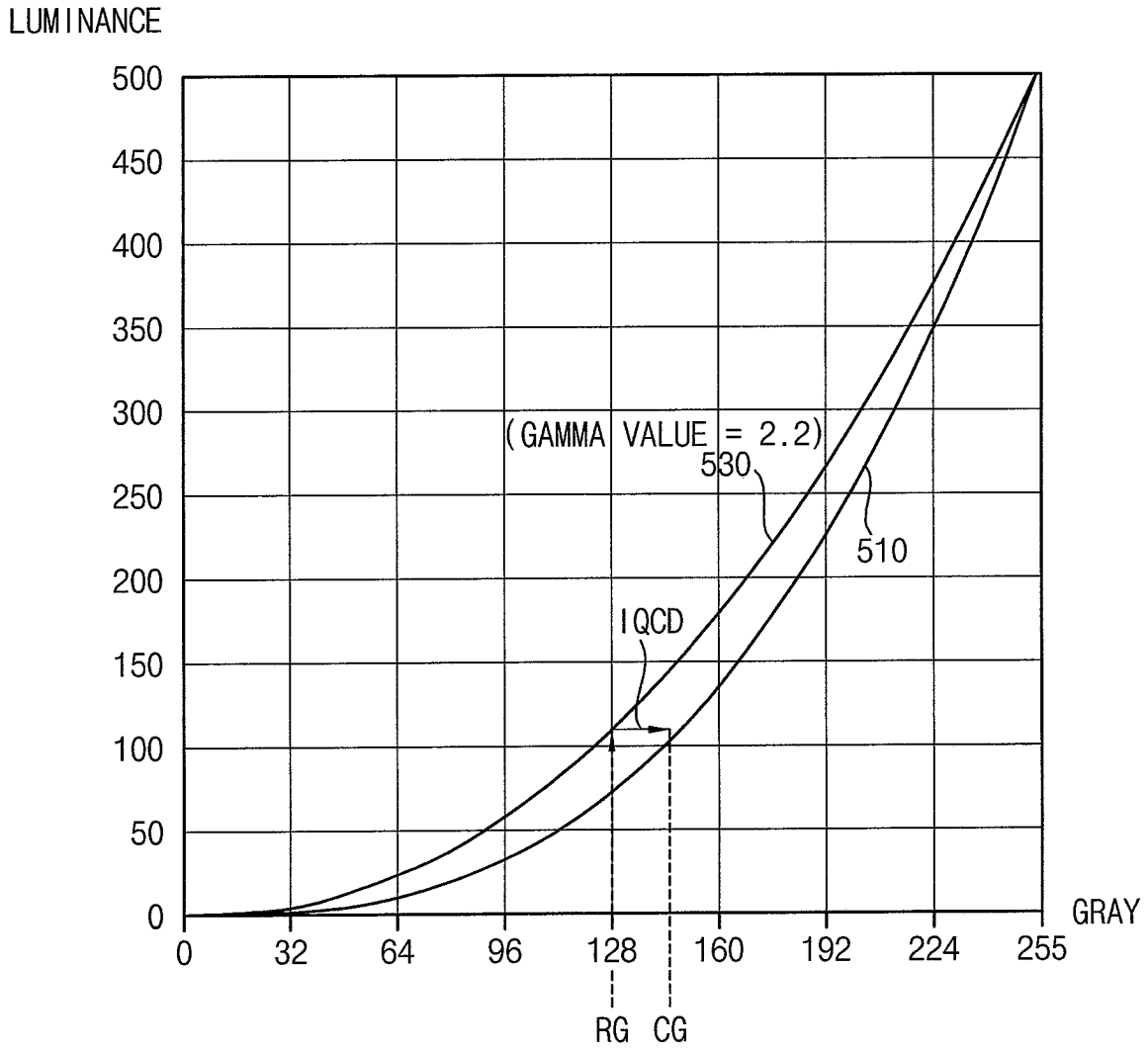
FIG. 5 is a diagram for describing an example of image quality correction.
Figure 6:
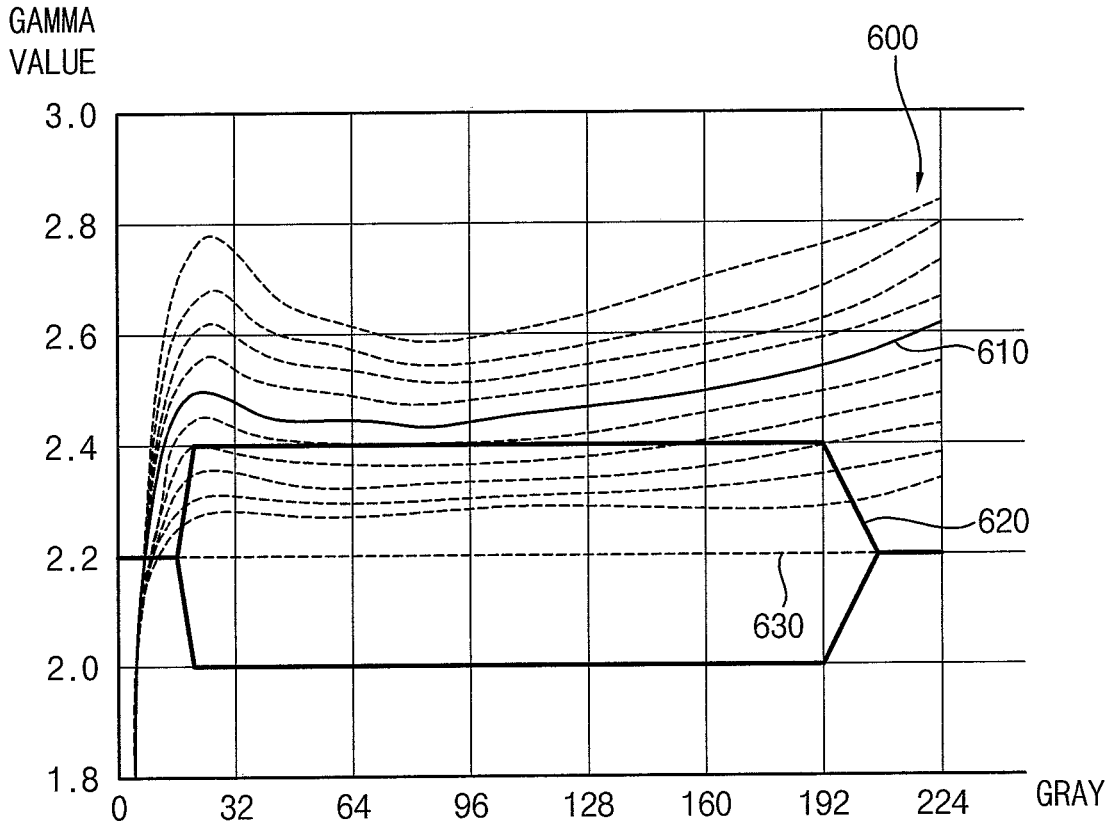
FIG. 6 is a block diagram illustrating an example of a gamma characteristic distribution of initial display devices.
Figure 7:
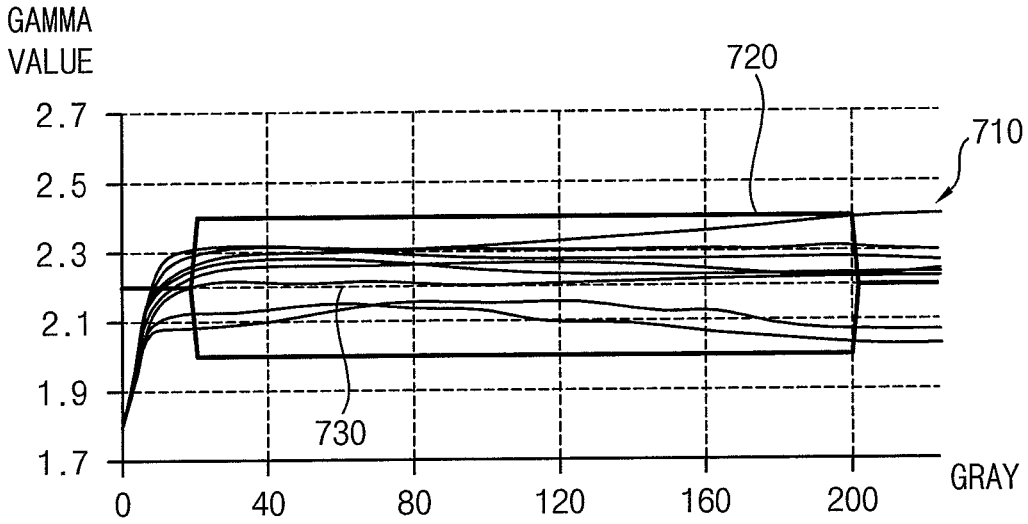
FIG. 7 is a block diagram illustrating an example of a gamma characteristic distribution of subsequent display devices to which center characteristic compensation data are applied.
Figure 8:
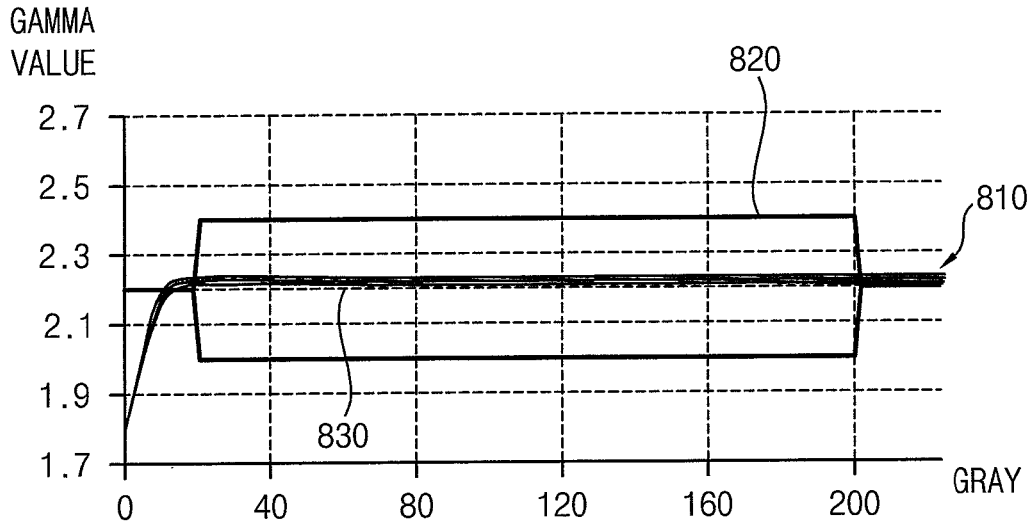
FIG. 8 is a block diagram illustrating an example of a gamma characteristic distribution of subsequent display devices on which mura correction and image quality correction are performed.
Figure 9:
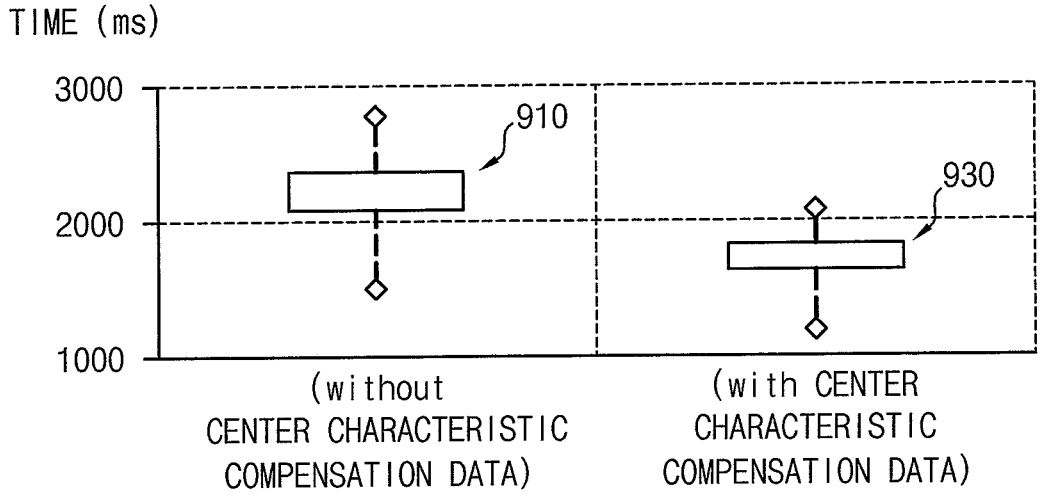
FIG. 9 is a diagram illustrating an example of a capturing time when center characteristic compensation data are not used and an example of a capturing time when the center characteristic compensation data are used.

FIG. 2 is a flowchart illustrating a method of generating correction data for each display device according to some example embodiments, FIG. 3 is a diagram for describing an example of a plurality of reference gray levels at which an image is captured, FIG. 4 is a diagram for describing an example of mura correction, FIG. 5 is a diagram for describing an example of image quality correction, FIG. 6 is a block diagram illustrating an example of a gamma characteristic distribution of initial display devices, FIG. 7 is a block diagram illustrating an example of a gamma characteristic distribution of subsequent display devices to which center characteristic compensation data are applied, FIG. 8 is a block diagram illustrating an example of a gamma characteristic distribution of subsequent display devices on which mura correction and image quality correction are performed, and FIG. 9 is a diagram illustrating an example of a capturing time when image quality correction data are not used and an example of a capturing time when the image quality correction data are used.

Referring to FIGS. 1 and 2, in a method of generating correction data for each display device 200 of a plurality of display devices according to some example embodiments, an automatic test process (e.g., an automatic manual test (AMT) process) including mura correction and image quality correction may be performed on each display device 200. In the method of generating the correction data, a characteristic distribution for initial display devices among the plurality of display devices may be obtained, and center characteristic compensation data may be generated based on the characteristic distribution for the initial display devices.

With respect to each initial display device 200 (S310: YES), a test device 100 may provide test data to each initial display device 200, and a capturing device 110 may obtain measured data by capturing an image displayed based on the test data at each initial display device 200 (S315). According to some example embodiments, the test device 100 may respectively provide a plurality of test data representing the entire gray levels (e.g., from a 0-gray level to a 255-gray level) to each initial display device 200, and the capturing device 110 may obtain a plurality of measured data for the entire gray levels by respectively capturing images at the entire gray levels.

According to some example embodiments, as illustrated in FIG. 3, the test device 100 may respectively provide one or more test data representing one or more reference gray levels, for example, including a 0-gray level 0G, a 16-gray level 16G, a 24-gray level 24G, a 32-gray level 32G, a 64-gray level 64G, a 128-gray level 128G, a 160-gray level 160G, a 192-gray level 192G, a 224-gray level 224G and a 255-gray level 255G that are a portion of the entire gray levels to each initial display device 200, and the capturing device 110 may obtain one or more measured data for the one or more reference gray levels by respectively capturing one or more images at the one or more reference gray levels.

A center characteristic corrector 130 may obtain a characteristic curve, for example a gamma characteristic curve of each initial display device 200 based on the measured data (S320). In a case where the gamma characteristic curves of the entire initial display devices are not obtained, or in a case where a reference number of the gamma characteristic curves are not obtained (S325: NO), the center characteristic corrector 130 may store the obtained gamma characteristic curve. Further, the test device 100 may perform mura correction and image quality correction on each initial display device 200 (S330 and S340).

According to some example embodiments, a mura corrector 150 may generate mura correction data for each initial display device 200 by performing the mura correction based on the measured data for each initial display device 200 (S330). FIG. 4 illustrates an example of a luminance graph 410 corresponding to the measured data and a target luminance graph 430. Referring to FIG. 4, the mura corrector 150 may generate the mura correction data based on a difference between the luminance graph 410 corresponding to the measured data and the target luminance graph 430.

For example, the mura corrector 150 may generate the mura correction data representing compensation gray values corresponding to differences MCD1, MCD2, MCD3, MCD4 and MCD5 between the luminance graph 410 and the target luminance graph 430 at a plurality of sampling positions SP1, SP2, SP3, SP4 and SP5. Although FIG. 4 illustrates the sampling positions SP1, SP2, SP3, SP4 and SP5 only in one row of a display panel or a portion of one row of the display panel for convenience of illustration, according to some example embodiments, the mura correction data may represent compensation gray values at a plurality of sampling positions arranged two-dimensionally. Further, according to some example embodiments, at each sampling position, the mura correction data may represent compensation gray values at the entire gray levels, or may represent one or more compensation gray values at one or more reference gray levels.

An image quality corrector 170 may generate image quality correction data for each initial display device 200 by performing the image quality correction based on the measured data for each initial display device 200 (S340). FIG. 5 illustrates an example of a gamma characteristic curve 510 corresponding to the measured data and a target gamma characteristic curve 530 (e.g., corresponding to a gamma value of about 2.2). Referring to FIG. 5, the image quality corrector 170 may generate the image quality correction data based on a difference between the gamma characteristic curve 510 corresponding to the measured data and the target gamma characteristic curve 530.

For example, to generate the image quality correction data at a reference gray level RG, the image quality corrector 170 may search a compensation gray level CG which allows luminance of the gamma characteristic curve 510 to be substantially the same as luminance of the target gamma characteristic curve 530 at the reference gray level RG, and may calculate a difference IQCD between the compensation gray level CG and the reference gray level RG. The image quality correction data at the reference gray level RG may represent a compensation gray value corresponding to the difference IQCD between the compensation gray level CG and the reference gray level RG. According to some example embodiments, the image quality corrector 170 may generate the image quality correction data at a reference position, for example a center point of each initial display device 200. Further, according to some example embodiments, the image quality correction data may represent compensation gray values at the entire gray levels, or may represent one or more compensation gray values at one or more reference gray levels.

The test device 100 may write default center characteristic compensation data (e.g., representing compensation gray values of 0), the mura correction data for each initial display device 200 and the image quality correction data for each initial display device 200 into each initial display device 200. These capturing the image (S315), obtaining the characteristic curve (S320), the mura correction (S330) and the image quality correction (S340) may be performed sequentially with respect to the reference number of the initial display devices.

In a case where the gamma characteristic curves of the entire initial display devices are obtained, or in a case where the reference number of the gamma characteristic curves are obtained (S325: YES), the center characteristic corrector 130 may generate the center characteristic compensation data based on the characteristic distribution, for example a gamma characteristic distribution for the initial display devices (S350 and S355).

FIG. 6 illustrates an example of the gamma characteristic distribution 600 including the gamma characteristic curves of the initial display devices, an average gamma characteristic curve 610 of the gamma characteristic curves, a gamma characteristic requirement 620 for the plurality of display devices and a target gamma characteristic curve 630 (corresponding to a gamma value of about 2.2). Referring to FIG. 6, according to some example embodiments, the center characteristic corrector 130 may calculate the average gamma characteristic curve 610 of the gamma characteristic curves of the initial display devices (S350), and may generate the center characteristic compensation data based on the average gamma characteristic curve 610 and the target gamma characteristic curve 630. For example, the center characteristic compensation data may represent compensation gray values which allow the average gamma characteristic curve 610 to become the target gamma characteristic curve 630.

With respect to each subsequent display device 200 that is subsequent to the initial display devices among the plurality of display devices (S310: NO), the test device 100 may apply the center characteristic compensation data to each subsequent display device 200 (S360).

According to some example embodiments, to apply the center characteristic compensation data to each subsequent display device 200 (S360), the test device 100 may write the center characteristic compensation data into each subsequent display device 200. The test device 100 may provide test data to each subsequent display device 200. Each subsequent display device 200 may add the center characteristic compensation data to the test data, and may display an image based on the test data to which the center characteristic compensation data are added. The capturing device 110 may obtain measured data on which the center characteristic compensation data are reflected by capturing the image displayed based on the test data to which the center characteristic compensation data are added at each subsequent display device 200 (S365).

According to some example embodiments, to apply the center characteristic compensation data to each subsequent display device 200 (S360), the test device 100 may provide test data to which the center characteristic compensation data are added to each subsequent display device 200. Each subsequent display device 200 may display an image based on the test data to which the center characteristic compensation data are added. The capturing device 110 may obtain measured data on which the center characteristic compensation data are reflected by capturing the image displayed based on the test data to which the center characteristic compensation data are added at each subsequent display device 200 (S365).

As illustrated in FIG. 7, a gamma characteristic distribution 710 for the subsequent display devices corresponding to the measured data on which the center characteristic compensation data are reflected may be close to a target gamma characteristic curve 730 (substantially the same as the target gamma characteristic curve 630 illustrated in FIG. 6). For example, as illustrated in FIG. 7, the gamma characteristic distribution 710 for the subsequent display devices may satisfy a gamma characteristic requirement 720 (substantially the same as the gamma characteristic requirement 620 illustrated in FIG. 6) for the plurality of display devices.

The test device 100 may generate mura correction data and image quality correction data by performing mura correction and image quality correction on each subsequent display device 200 to which the center characteristic compensation data are applied (S370 and S380). According to some example embodiments, the mura corrector 150 may generate the mura correction data by performing the mura correction (e.g., as illustrated in FIG. 4) based on the measured data on which the center characteristic compensation data are reflected (S370). The test device 100 may generate the measured data on which the center characteristic compensation data and the mura correction data are reflected by adding the mura correction data to the measured data on which the center characteristic compensation data are reflected. The image quality corrector 170 may generate the image quality correction data by performing the image quality correction (e.g., as illustrated in FIG. 5) based on the measured data on which the center characteristic compensation data and the mura correction data are reflected (S380). The test device 100 may write the center characteristic compensation data, the mura correction data and the image quality correction data into each subsequent display device 200.

FIG. 8 illustrates an example of a gamma characteristic distribution 810 for the subsequent display devices after the mura correction and the image quality correction are performed. If the mura correction and the image quality correction are completed, the gamma characteristic distribution 810 of the subsequent display devices may be more close to a target gamma characteristic curve 830 (substantially the same as the target gamma characteristic curves 630 and 730 illustrated in FIGS. 6 and 7), and may satisfy a gamma characteristic requirement 820 (substantially the same as the gamma characteristic requirements 620 and 720 illustrated in FIGS. 6 and 7).

FIG. 9 illustrates an example of a capturing time 910 when the center characteristic compensation data are not used and an example of a capturing time 930 when the center characteristic compensation data are used. For example, if the center characteristic compensation data are applied to each subsequent display device 200, a gamma characteristic curve (for example, corresponding to a gamma value greater than about 2.2) of each subsequent display device 200 may be changed close to a target gamma characteristic curve (for example, corresponding to a gamma value of about 2.2). In this case, as illustrated in FIG. 9, a capturing time of each subsequent display device 200 may be reduced from the capturing time 910 of about 2270 ms to the capturing time 930 of about 1760 ms. Accordingly, a test process time for each subsequent display device 200 may be reduced.

As described above, in the method of generating the correction data according to some example embodiments, the center characteristic compensation data may be generated by obtaining the characteristic distribution for the initial display devices, the center characteristic compensation data may be applied to the subsequent display devices, and the mura correction and the image quality correction may be performed on each subsequent display device 200 to which the center characteristic compensation data are applied. Accordingly, the mura correction and the image quality correction for each (subsequent) display device 200 may be rapidly and accurately performed.

Figure 10:
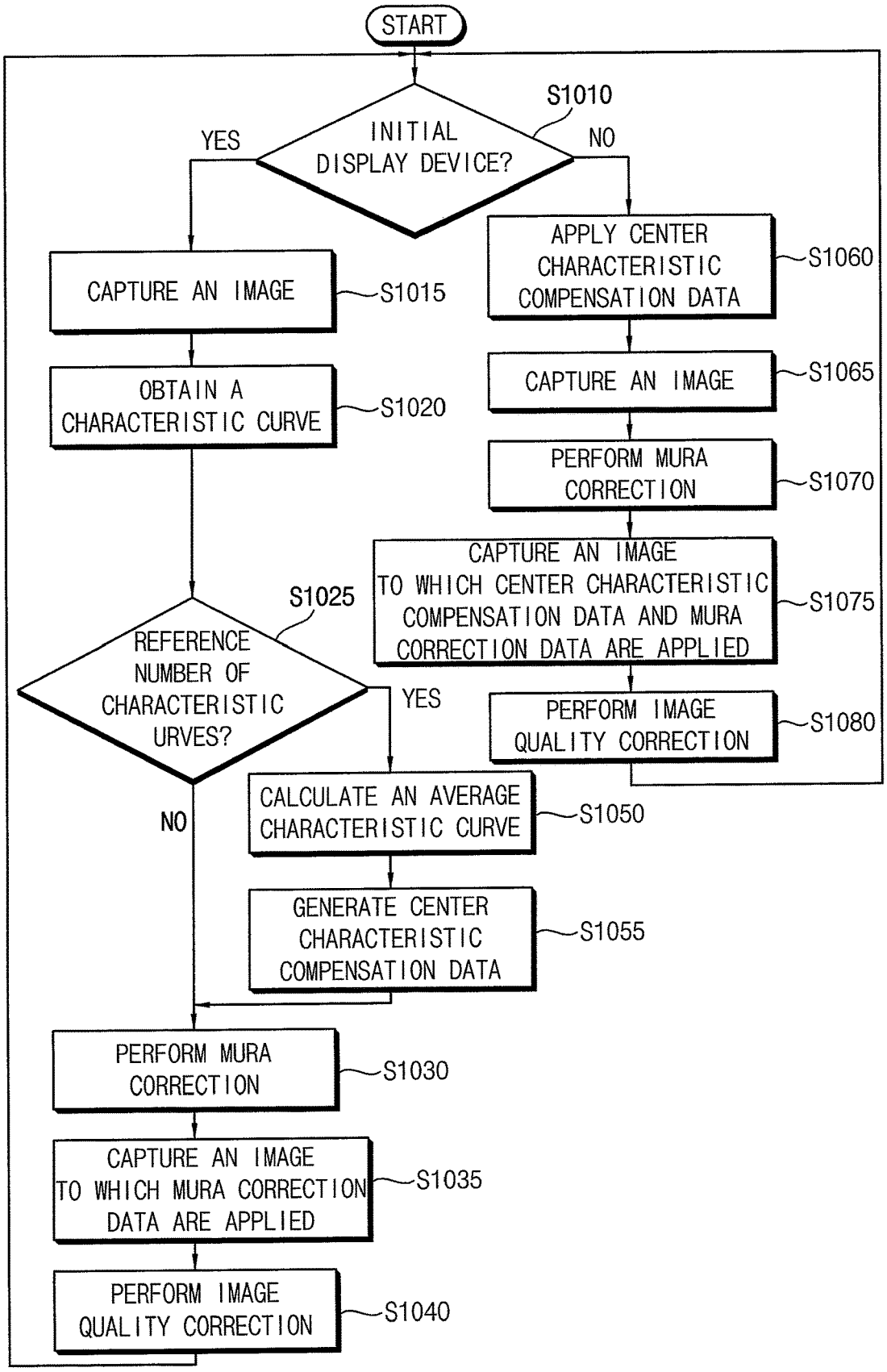
FIG. 10 is a flowchart illustrating a method of generating correction data for each display device according to some example embodiments.

FIG. 10 is a flowchart illustrating a method of generating correction data for each display device according to some example embodiments.

Unlike a method of FIG. 2 which performs mura correction and image quality correction substantially simultaneously (or concurrently) (or by capturing a single image at each gray level) with respect to each display device, a method of FIG. 10 may perform mura correction, and then may perform image quality correction with respect to each display device.

Referring to FIGS. 1 and 10, in a method of generating correction data according to some example embodiments, with respect to each initial display device 200 (S1010: YES), a test device 100 may provide test data to each initial display device 200, and a capturing device 110 may obtain first measured data by capturing a first image displayed based on the test data at each initial display device 200 (S1015). A center characteristic corrector 130 may obtain a characteristic curve, for example a gamma characteristic curve of each initial display device 200 based on the first measured data (S1020). A mura corrector 150 may generate mura correction data for each initial display device 200 by performing mura correction based on the first measured data for each initial display device 200 (S1030).

The test device 100 may apply the mura correction data to each initial display device 200. For example, the test device 100 may write the mura correction data into each initial display device 200. The test device 100 may provide test data to each initial display device 200, and each initial display device 200 may add the mura correction data to the test data, and may display a second image based on the test data to which the mura correction data are added. The capturing device 110 may obtain second measured data by capturing the second image displayed based on the test data to which the mura correction data are added at each initial display device 200 (S1035). An image quality corrector 170 may generate image quality correction data for each initial display device 200 by performing image quality correction based on the second measured data for each initial display device 200 (S1040). The test device 100 may write default center characteristic compensation data, the mura correction data for each initial display device 200 and the image quality correction data for each initial display device 200 into each initial display device 200. These capturing the first image (S1015), obtaining the characteristic curve (S1020), the mura correction (S1030), capturing the second image (S1035) and the image quality correction (S1040) may be performed sequentially with respect to a reference number of the initial display devices.

In a case where gamma characteristic curves of the entire initial display devices are obtained, or in a case where the reference number of the gamma characteristic curves are obtained (S1025: YES), the center characteristic corrector 130 may calculate an average gamma characteristic curve of the gamma characteristic curves of the initial display devices (S1050), and may generate center characteristic compensation data based on the average gamma characteristic curve and a target gamma characteristic curve (S1055).

With respect to each subsequent display device 200 that is subsequent to the initial display devices among the plurality of display devices (S1010: NO), the test device 100 may apply the center characteristic compensation data to each subsequent display device 200 (S1060). The capturing device 110 may obtain third measured data on which the center characteristic compensation data are reflected by capturing a third image displayed based on test data to which the center characteristic compensation data are added at each subsequent display device 200 (S1065). The mura corrector 150 may generate mura correction data by performing mura correction based on the third measured data on which the center characteristic compensation data are reflected (S1070).

The test device 100 may further apply the mura correction data to each subsequent display device 200. For example, the test device 100 may write the mura correction data into each subsequent display device 200. The capturing device 110 may obtain fourth measured data on which the center characteristic compensation data and the mura correction data are reflected by capturing a fourth image displayed based on test data to which the center characteristic compensation data and the mura correction data are added at each subsequent display device 200 (S1075). The image quality corrector 170 may generate the image quality correction data by performing the image quality correction based on the fourth measured data on which the center characteristic compensation data and the mura correction data are reflected (S1080). The test device 100 may write the center characteristic compensation data, the mura correction data and the image quality correction data into each subsequent display device 200.

Figure 11:
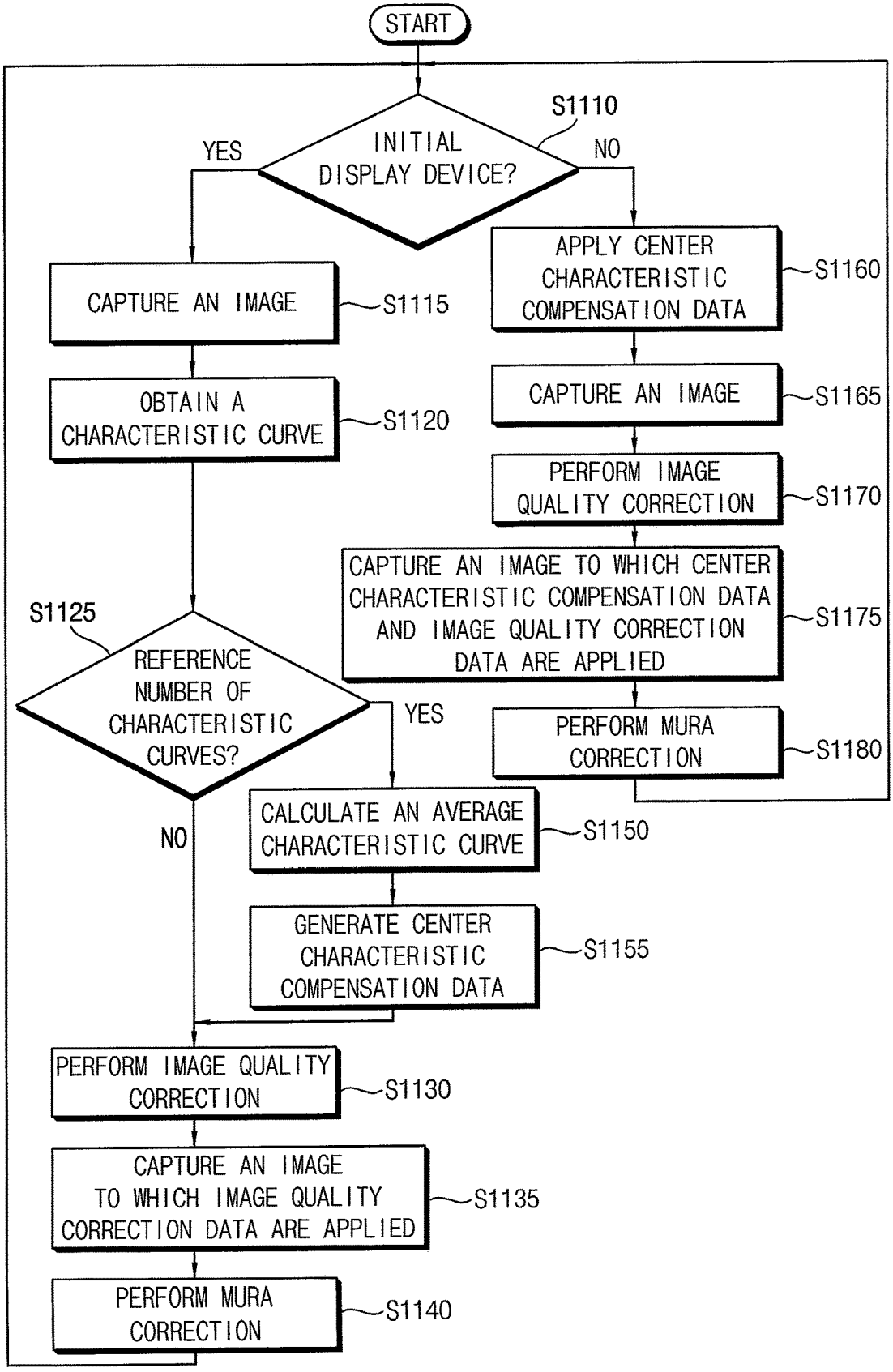
FIG. 11 is a flowchart illustrating a method of generating correction data for each display device according to some example embodiments.

FIG. 11 is a flowchart illustrating a method of generating correction data for each display device according to some example embodiments.

Unlike a method of FIG. 2 which performs mura correction and image quality correction substantially simultaneously (or concurrently) (or by capturing a single image at each gray level) with respect to each display device, a method of FIG. 11 may perform image quality correction, and then may perform mura correction with respect to each display device.

Referring to FIGS. 1 and 11, in a method of generating correction data according to some example embodiments, with respect to each initial display device 200 (S1110: YES), a test device 100 may provide test data to each initial display device 200, and a capturing device 110 may obtain first measured data by capturing a first image displayed based on the test data at each initial display device 200 (S1115). A center characteristic corrector 130 may obtain a characteristic curve, for example a gamma characteristic curve of each initial display device 200 based on the first measured data (S1120). An image quality corrector 170 may generate image quality correction data for each initial display device 200 by performing image quality correction based on the first measured data for each initial display device 200 (S1130).

The test device 100 may apply the image quality correction data to each initial display device 200. For example, the test device 100 may write the image quality correction data into each initial display device 200. The test device 100 may provide test data to each initial display device 200, and each initial display device 200 may add the image quality correction data to the test data, and may display a second image based on the test data to which the image quality correction data are added. The capturing device 110 may obtain second measured data by capturing the second image displayed based on the test data to which the image quality correction data are added at each initial display device 200 (S1135). A mura corrector 150 may generate mura correction data for each initial display device 200 by performing mura correction based on the second measured data for each initial display device 200 (S1140). The test device 100 may write default center characteristic compensation data, the mura correction data for each initial display device 200 and the image quality correction data for each initial display device 200 into each initial display device 200. These capturing the first image (S1115), obtaining the characteristic curve (S1120), the image quality correction (S1130), capturing the second image (S1135) and the mura correction (S1140) may be performed sequentially with respect to a reference number of the initial display devices.

In a case where gamma characteristic curves of the entire initial display devices are obtained, or in a case where the reference number of the gamma characteristic curves are obtained (S1125: YES), the center characteristic corrector 130 may calculate an average gamma characteristic curve of the gamma characteristic curves of the initial display devices (S1150), and may generate center characteristic compensation data based on the average gamma characteristic curve and a target gamma characteristic curve (S1155).

With respect to each subsequent display device 200 that is subsequent to the initial display devices among the plurality of display devices (S1110: NO), the test device 100 may apply the center characteristic compensation data to each subsequent display device 200 (S1160). The capturing device 110 may obtain third measured data on which the center characteristic compensation data are reflected by capturing a third image displayed based on test data to which the center characteristic compensation data are added at each subsequent display device 200 (S1165). The image quality corrector 170 may generate image quality correction data by performing image quality correction based on the third measured data on which the center characteristic compensation data are reflected (S1170).

The test device 100 may further apply the image quality correction data to each subsequent display device 200. For example, the test device 100 may write the image quality correction data into each subsequent display device 200. The capturing device 110 may obtain fourth measured data on which the center characteristic compensation data and the image quality correction data are reflected by capturing a fourth image displayed based on test data to which the center characteristic compensation data and the image quality correction data are added at each subsequent display device 200 (S1175). The mura corrector 150 may generate mura correction data by performing mura correction based on the fourth measured data on which the center characteristic compensation data and the image quality correction data are reflected (S1180). The test device 100 may write the center characteristic compensation data, the mura correction data and the image quality correction data into each subsequent display device 200.

Figure 12:
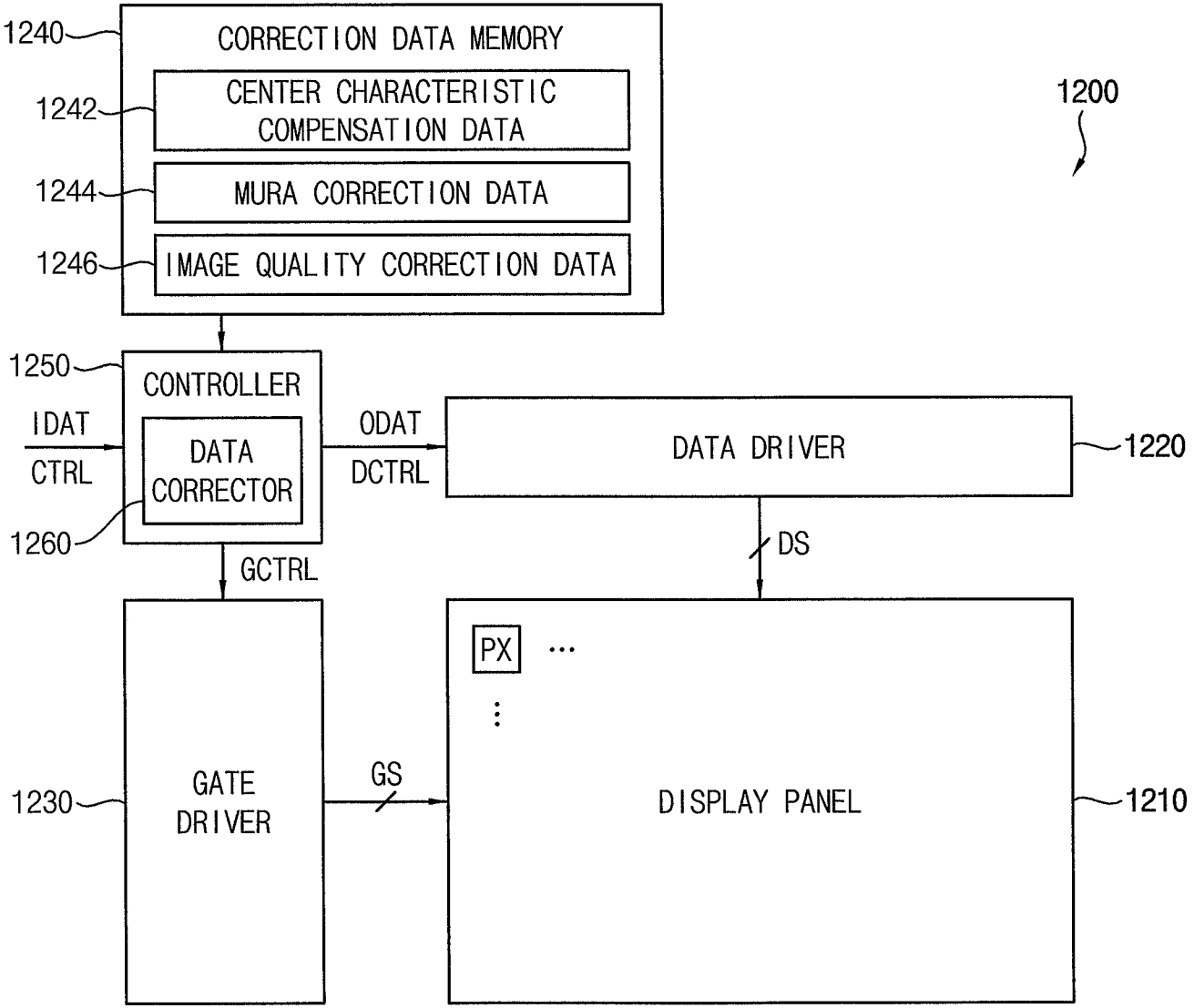
FIG. 12 is a block diagram illustrating a display device according to some example embodiments.
Figure 13:
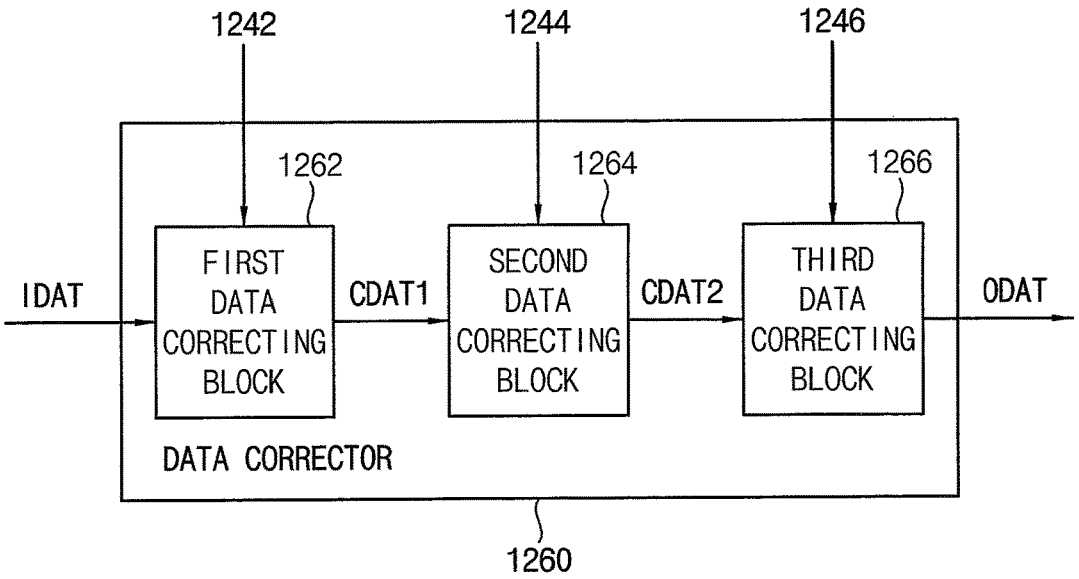
FIG. 13 is a block diagram illustrating an example of a data corrector included in a display device according to some example embodiments.

FIG. 12 is a block diagram illustrating a display device according to some example embodiments, and FIG. 13 is a block diagram illustrating an example of a data corrector included in a display device according to some example embodiments.

Referring to FIG. 12, a display device 1200 according to some example embodiments may include a display panel 1210 including a plurality of pixels PX, a data driver 1220 providing data signals DS to the plurality of pixels PX, a gate driver 1230 providing gate signals GS to the plurality of pixels PX, a correction data memory 1240 storing center characteristic compensation data 1242, mura correction data 1244 and image quality correction data 1246, and a controller 1250 controlling an operation of the display device 1200.

The display panel 1210 may include a plurality of data lines, a plurality of gate lines, and the plurality of pixels PX coupled to the plurality of data lines and the plurality of gate lines. According to some example embodiments, each pixel PX may include a switching transistor and a liquid crystal capacitor coupled to the switching transistor, and the display panel 1210 may be a liquid crystal display (LCD) panel. According to some example embodiments, each pixel PX may include an organic light emitting diode (OLED), at least one capacitor and at least two transistors, and the display panel 1210 may be an OLED display panel. However, the display panel 1210 may not be limited to the LCD panel and the OLED display panel, and may be any suitable display panel.

The data driver 1220 may generate the data signals DS based on output image data ODAT and a data control signal DCTRL received from the controller 1250, and may provide the data signals DS corresponding to the output image data ODAT to the plurality of pixels PX. For example, the data control signal DCTRL may include, but not limited to, an output data enable signal, a horizontal start signal and a load signal. According to some example embodiments, the data driver 1220 may be implemented with one or more data integrated circuits (ICs). Further, according to some example embodiments, the data driver 1220 may be mounted directly on the display panel 1210 in a form of a chip on glass (COG) manner or a chip on plastic (COP) manner, or may be coupled to the display panel 1210 in a form of a chip on film (COF) manner. According to some example embodiments, the data driver 1220 may be integrated in a peripheral portion of the display panel 1210.

The gate driver 1230 may generate the gate signals GS based on a gate control signal GCTRL from the controller 1250, and may provide the gate signals GS to the plurality of pixels PX. According to some example embodiments, the gate control signal GCTRL may include, but not limited to, a frame start signal and a gate clock signal. According to some example embodiments, the gate driver 1230 may be implemented as an amorphous silicon gate (ASG) driver integrated in the peripheral portion of the display panel 1210. According to some example embodiments, the gate driver 1230 may be implemented with one or more gate ICs. Further, according to some example embodiments, the gate driver 1230 may be mounted directly on the display panel 1210 in the form of the COG manner or the COP manner, or may be coupled to the display panel 1210 in the form of the COF manner.

The correction data memory 1240 may store the center characteristic compensation data 1242, the mura correction data 1244 and the image quality correction data 1246. The center characteristic compensation data 1242 may be generated by obtaining a characteristic distribution (e.g., a gamma characteristic distribution) for initial display devices among a plurality of display devices. According to some example embodiments, the center characteristic compensation data 1242 stored in the correction data memory 1240 may be constant or substantially the same with respect to different display devices. The mura correction data 1244 may be generated by performing mura correction on the display device 1200 to which the center characteristic compensation data 1242 are applied or written. Further, the image quality correction data 1246 may be generated by performing image quality correction on the display device 1200 to which the center characteristic compensation data 1242 are applied or written.

The controller 1250 (e.g., a timing controller; TCON) may receive input image data IDAT and a control signal CTRL from an external host processor (e.g., a graphic processing unit (GPU) or a graphic card). According to some example embodiments, the control signal CTRL may include, but not limited to, a vertical synchronization signal, a horizontal synchronization signal, an input data enable signal, a master clock signal, etc. The controller 1250 may generate the output image data ODAT, the data control signal DCTRL and the gate control signal GCTRL based on the input image data IDAT and the control signal CTRL. The controller 1250 may control an operation of the data driver 1220 by providing the output image data ODAT and the data control signal DCTRL to the data driver 1220, and may control an operation of the gate driver 1230 by providing the gate control signal GCTRL to the gate driver 1230.

The controller 1250 may include a data corrector 1260 that generates the output image data ODAT by correcting the input image data IDAT based on the center characteristic compensation data 1242, the mura correction data 1244 and the image quality correction data 1246. According to some example embodiments, as illustrated in FIG. 13, the data corrector 1260 may include a first data correcting block 1262, a second data correcting block 1264 and a third data correcting block 1266. The first data correcting block 1262 may receive the center characteristic compensation data 1242 from the correction data memory 1240, and may generate first corrected image data CDAT1 by adding the center characteristic compensation data 1242 to the input image data IDAT. The second data correcting block 1264 may receive the mura correction data 1244 from the correction data memory 1240, and may generate second corrected image data CDAT2 by adding the mura correction data 1244 to the first corrected image data CDAT1. The third data correcting block 1266 may receive the image quality correction data 1246 from the correction data memory 1240, and may generate the output image data ODAT by adding the image quality correction data 1246 to the second corrected image data CDAT2. Although FIG. 13 illustrates an example where correction data 1242, 1244 and 1246 are added in an order of the center characteristic compensation data 1242, the mura correction data 1244 and the image quality correction data 1246, the order of the addition according to some example embodiments are not limited to the example of FIG. 13.

As described above, the display device 1200 according to some example embodiments may store the center characteristic compensation data 1242, the mura correction data 1244 and the image quality correction data 1246, and may correct the input image data IDAT based on the center characteristic compensation data 1242, the mura correction data 1244 and the image quality correction data 1246. Accordingly, a mura defect of the display device 1200 may be reduced or removed, and an image quality of the display device 1200 may be improved.

Figure 14:
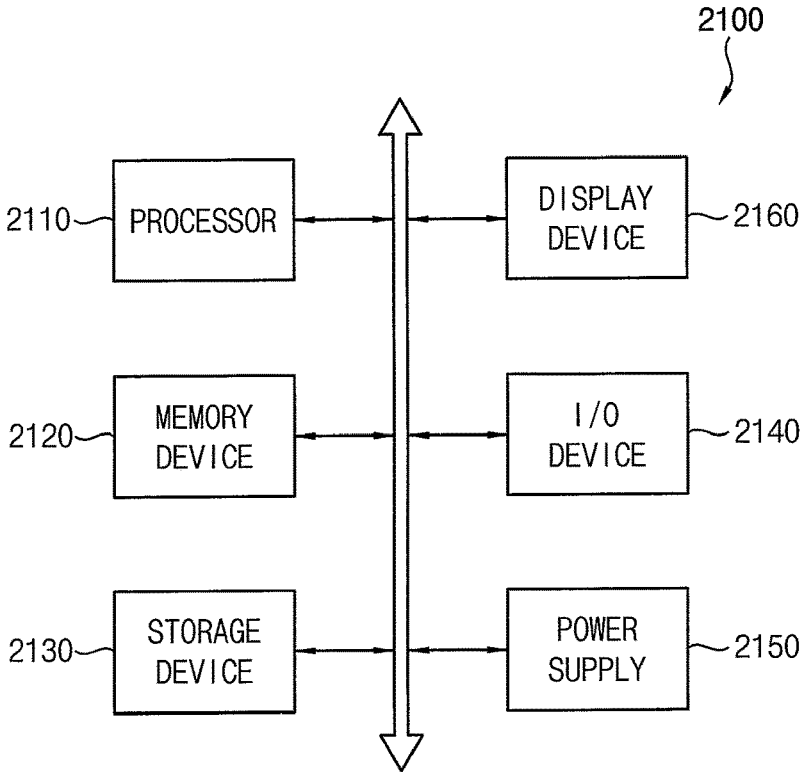
FIG. 14 is a block diagram illustrating an electronic device including a display device according to some example embodiments.

FIG. 14 is a block diagram illustrating an electronic device including a display device according to some example embodiments.

Referring to FIG. 14, an electronic device 2100 may include a processor 2110, a memory device 2120, a storage device 2130, an input/output (I/O) device 2140, a power supply 2150, and a display device 2160. The electronic device 2100 may further include a plurality of ports for communicating a video card, a sound card, a memory card, a universal serial bus (USB) device, other electric devices, etc.

The processor 2110 may perform various computing functions or tasks. The processor 2110 may be an application processor (AP), a micro processor, a central processing unit (CPU), etc. The processor 2110 may be coupled to other components via an address bus, a control bus, a data bus, etc. Further, according to some example embodiments, the processor 2110 may be further coupled to an extended bus such as a peripheral component interconnection (PCI) bus.

The memory device 2120 may store data for operations of the electronic device 2100. For example, the memory device 2120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 2130 may be a solid state drive (SSD) device, a hard disk drive (HDD) device, a CD-ROM device, etc. The I/O device 2140 may be an input device such as a keyboard, a keypad, a mouse, a touch screen, etc, and an output device such as a printer, a speaker, etc. The power supply 2150 may supply power for operations of the electronic device 2100. The display device 2160 may be coupled to other components through the buses or other communication links.

The display device 2160 may store center characteristic compensation data, mura correction data and image quality correction data, and may correct image data based on the center characteristic compensation data, the mura correction data and the image quality correction data. Accordingly, a mura defect of the display device 2160 may be reduced or removed, and an image quality of the display device 2160 may be improved.

The inventive concepts may be applied to any display device 2160, and any electronic device 2100 including the display device 2160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of aspects of some example embodiments and is not to be construed as limiting thereof. Although aspects of some example embodiments have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A method of generating correction data for each of a plurality of display devices, the method comprising:

obtaining a characteristic distribution for initial display devices among the plurality of display devices;

generating center characteristic compensation data based on the characteristic distribution for the initial display devices;

applying the center characteristic compensation data to subsequent display devices that are subsequent to the initial display devices among the plurality of display devices;

generating mura correction data and image quality correction data by performing mura correction and image quality correction on each of the subsequent display devices to which the center characteristic compensation data are applied; and writing the center characteristic compensation data, the mura correction data, and the image quality correction data into each of the subsequent display devices.

2. The method of claim 1, wherein obtaining the characteristic distribution for the initial display devices includes:

providing test data to each of the initial display devices;

obtaining measured data by capturing an image displayed based on the test data at each of the initial display devices; and obtaining gamma characteristic curves of the initial display devices based on the measured data.

3. The method of claim 2, wherein generating the center characteristic compensation data based on the characteristic distribution for the initial display devices includes:

calculating an average gamma characteristic curve of the gamma characteristic curves of the initial display devices; and generating the center characteristic compensation data based on the average gamma characteristic curve and a target gamma characteristic curve.

4. The method of claim 2, further comprising:

generating mura correction data for each of the initial display devices by performing mura correction based on the measured data for each of the initial display devices;

generating image quality correction data for each of the initial display devices by performing image quality correction based on the measured data for each of the initial display devices; and writing default center characteristic compensation data, the mura correction data for each of the initial display devices and the image quality correction data for each of the initial display devices into each of the initial display devices.

5. The method of claim 1, wherein applying the center characteristic compensation data to the subsequent display devices includes:

writing the center characteristic compensation data into each of the subsequent display devices;

providing test data to each of the subsequent display devices;

adding the center characteristic compensation data to the test data at each of the subsequent display devices; and displaying an image based on the test data to which the center characteristic compensation data are added at each of the subsequent display devices.

6. The method of claim 1, wherein applying the center characteristic compensation data to the subsequent display devices includes:

providing test data to which the center characteristic compensation data are added to each of the subsequent display devices; and displaying an image based on the test data to which the center characteristic compensation data are added at each of the subsequent display devices.

7. The method of claim 1, wherein generating the mura correction data and the image quality correction data by performing the mura correction and the image quality correction on each of the subsequent display devices to which the center characteristic compensation data are applied includes:

obtaining measured data on which the center characteristic compensation data are reflected by capturing an image displayed based on test data to which the center characteristic compensation data are added at each of the subsequent display devices;

generating the mura correction data by performing the mura correction based on the measured data on which the center characteristic compensation data are reflected;

generating the measured data on which the center characteristic compensation data and the mura correction data are reflected by adding the mura correction data to the measured data on which the center characteristic compensation data are reflected; and generating the image quality correction data by performing the image quality correction based on the measured data on which the center characteristic compensation data and the mura correction data are reflected.

8. The method of claim 1, wherein generating the mura correction data and the image quality correction data by performing the mura correction and the image quality correction on each of the subsequent display devices to which the center characteristic compensation data are applied includes:

obtaining first measured data on which the center characteristic compensation data are reflected by capturing an image displayed based on test data to which the center characteristic compensation data are added at each of the subsequent display devices;

generating the mura correction data by performing the mura correction based on the first measured data on which the center characteristic compensation data are reflected;

obtaining second measured data on which the center characteristic compensation data and the mura correction data are reflected by capturing an image displayed based on the test data to which the center characteristic compensation data and the mura correction data are added at each of the subsequent display devices; and generating the image quality correction data by performing the image quality correction based on the second measured data on which the center characteristic compensation data and the mura correction data are reflected.

9. The method of claim 1, wherein generating the mura correction data and the image quality correction data by performing the mura correction and the image quality correction on each of the subsequent display devices to which the center characteristic compensation data are applied includes:

obtaining first measured data on which the center characteristic compensation data are reflected by capturing an image displayed based on test data to which the center characteristic compensation data are added at each of the subsequent display devices;

generating the image quality correction data by performing the image quality correction based on the first measured data on which the center characteristic compensation data are reflected;

obtaining second measured data on which the center characteristic compensation data and the image quality correction data are reflected by capturing an image displayed based on the test data to which the center characteristic compensation data and the image quality correction data are added at each of the subsequent display devices; and generating the mura correction data by performing the mura correction based on the second measured data on which the center characteristic compensation data and the image quality correction data are reflected.

10. A test device configured to generate correction data for each of a plurality of display devices, the test device comprising:

a center characteristic corrector configured to obtain a characteristic distribution for initial display devices among the plurality of display devices, to generate center characteristic compensation data based on the characteristic distribution for the initial display devices, and to apply the center characteristic compensation data to subsequent display devices that are subsequent to the initial display devices among the plurality of display devices;

a mura corrector configured to generate mura correction data by performing mura correction on each of the subsequent display devices to which the center characteristic compensation data are applied; and an image quality corrector configured to generate image quality correction data by performing image quality correction on each of the subsequent display devices to which the center characteristic compensation data are applied.

11. The test device of claim 10, wherein the test device is configured to provide test data to each of the initial display devices, wherein the test device further comprises:

a capturing device configured to obtain measured data by capturing an image displayed based on the test data at each of the initial display devices, and wherein the center characteristic corrector is configured to obtain gamma characteristic curves of the initial display devices based on the measured data, to calculate an average gamma characteristic curve of the gamma characteristic curves of the initial display devices, and to generate the center characteristic compensation data based on the average gamma characteristic curve and a target gamma characteristic curve.

12. The test device of claim 11, wherein the mura corrector is configured to generate mura correction data for each of the initial display devices by performing mura correction based on the measured data for each of the initial display devices, wherein the image quality corrector is configured to generate image quality correction data for each of the initial display devices by performing image quality correction based on the measured data for each of the initial display devices, and wherein the test device is configured to write default center characteristic compensation data, the mura correction data for each of the initial display devices and the image quality correction data for each of the initial display devices into each of the initial display devices.

13. The test device of claim 10, wherein the center characteristic compensation data are applied to the subsequent display devices by writing the center characteristic compensation data into each of the subsequent display devices.

14. The test device of claim 10, wherein the center characteristic compensation data are applied to the subsequent display devices by providing test data to which the center characteristic compensation data are added to each of the subsequent display devices.

15. The test device of claim 10, further comprising:

a capturing device configured to obtain measured data on which the center characteristic compensation data are reflected by capturing an image displayed based on test data to which the center characteristic compensation data are added at each of the subsequent display devices, wherein the mura corrector is configured to generate the mura correction data by performing the mura correction based on the measured data on which the center characteristic compensation data are reflected, wherein the measured data on which the center characteristic compensation data and the mura correction data are reflected are generated by adding the mura correction data to the measured data on which the center characteristic compensation data are reflected, and wherein the image quality corrector is configured to generate the image quality correction data by performing the image quality correction based on the measured data on which the center characteristic compensation data and the mura correction data are reflected.

16. The test device of claim 10, further comprising:

a capturing device configured to obtain first measured data on which the center characteristic compensation data are reflected by capturing an image displayed based on test data to which the center characteristic compensation data are added at each of the subsequent display devices, and to obtain second measured data on which the center characteristic compensation data and the mura correction data are reflected by capturing an image displayed based on the test data to which the center characteristic compensation data and the mura correction data are added at each of the subsequent display devices, wherein the mura corrector is configured to generate the mura correction data by performing the mura correction based on the first measured data on which the center characteristic compensation data are reflected, and wherein the image quality corrector is configured to generate the image quality correction data by performing the image quality correction based on the second measured data on which the center characteristic compensation data and the mura correction data are reflected.

17. The test device of claim 10, further comprising:

a capturing device configured to obtain first measured data on which the center characteristic compensation data are reflected by capturing an image displayed based on test data to which the center characteristic compensation data are added at each of the subsequent display devices, and to obtain second measured data on which the center characteristic compensation data and the image quality correction data are reflected by capturing an image displayed based on the test data to which the center characteristic compensation data and the image quality correction data are added at each of the subsequent display devices, wherein the image quality corrector generates the image quality correction data by performing the image quality correction based on the first measured data on which the center characteristic compensation data are reflected, and wherein the mura corrector generates the mura correction data by performing the mura correction based on the second measured data on which the center characteristic compensation data and the image quality correction data are reflected.

* * * * *